US011896864B2

(12) United States Patent
Pitcher et al.

(10) Patent No.: US 11,896,864 B2
(45) Date of Patent: Feb. 13, 2024

(54) ROTATION RESISTANT EXERCISE DEVICE

(71) Applicants: David E. Pitcher, Swampscott, MA (US); Clint W. DeBerry, Tucson, AZ (US)

(72) Inventors: David E. Pitcher, Swampscott, MA (US); Clint W. DeBerry, Tucson, AZ (US)

( * ) Notice: Subject to any disclaimer, the term of this patent is extended or adjusted under 35 U.S.C. 154(b) by 211 days.

(21) Appl. No.: 17/300,796

(22) Filed: Nov. 9, 2021

(65) Prior Publication Data

US 2023/0145685 A1 May 11, 2023

(51) Int. Cl.
*A63B 21/00* (2006.01)
*A63B 21/22* (2006.01)

(52) U.S. Cl.
CPC ..... *A63B 21/00069* (2013.01); *A63B 21/22* (2013.01); *A63B 21/4035* (2015.10)

(58) Field of Classification Search
CPC ..... A63B 21/00069; A63B 21/22; A63B 21/4035
See application file for complete search history.

(56) References Cited

U.S. PATENT DOCUMENTS 3,132,861 A * 5/1964 Horney ..... A63B 21/4045 482/46
4,643,417 A 2/1987 Nieman
4,805,899 A * 2/1989 Roehlk ..... A63B 23/14 482/45
5,046,727 A * 9/1991 Wilkinson ..... A63B 21/015 428/909
5,263,908 A * 11/1993 Chen ..... A63B 21/4049 482/44
5,569,125 A 10/1996 Clementi
5,766,112 A * 6/1998 Chuan ..... A63B 21/045 482/121
5,941,799 A * 8/1999 Bergdorf ..... A63B 21/0455 482/44
6,071,214 A 6/2000 Osterman
6,773,377 B1 * 8/2004 Yu ..... A61H 7/003 482/110
7,326,158 B1 * 2/2008 Wang ..... A63B 43/02 482/8
8,506,461 B2 * 8/2013 Huang ..... A63B 21/05 482/79
8,636,625 B2 * 1/2014 Johnson ..... A63B 21/072 482/44

(Continued)

*Primary Examiner* — Andrew S Lo
(74) *Attorney, Agent, or Firm* — Don Halgren

(57) ABSTRACT

An exercise device designed to strengthen the entire body, with particular focus on the upper body. The device facilitates the strengthening of the core, chest, back, shoulder, and arm muscles, and in particular muscles that move the core in the transverse plane. The device consists of two hemispherical shells, both of which have handles attached via risers. This allows the device to be gripped either by the spherical surfaces, by the handles, or a combination thereof. The hemispheres are attached to each other by means of a shaft with a variable braking mechanism. The braking mechanism can provide levels of rotational resistance from almost zero to virtually impossible to rotate, with the resistance level visibly indicated on the exterior of the device. The resistance level is changed by repeatedly rotating the two halves against each other in one direction or the other.

25 Claims, 8 Drawing Sheets

(56) References Cited

U.S. PATENT DOCUMENTS

| | | | | |
|---|---|---|---|---|
| 8,747,286 | B1 | 6/2014 | Simon | |
| 8,870,719 | B2 * | 10/2014 | Johnson | A63B 21/072 482/44 |
| 9,192,814 | B1 * | 11/2015 | Smart | A63B 23/03541 |
| 9,216,315 | B1 * | 12/2015 | Chang | A63B 21/072 |
| 9,694,236 | B2 * | 7/2017 | Rost | A63B 21/0618 |
| D798,969 | S * | 10/2017 | Lozito | D21/682 |
| 9,833,653 | B2 * | 12/2017 | Bradford | A63B 23/1209 |
| 9,844,695 | B1 * | 12/2017 | Shorter | A63B 21/075 |
| 10,179,259 | B1 * | 1/2019 | Zagata | A63B 23/12 |
| 2008/0026915 | A1 * | 1/2008 | Chuang | A63B 21/00069 482/44 |
| 2012/0157270 | A1 * | 6/2012 | Johnson | A63B 21/072 482/93 |
| 2013/0059701 | A1 * | 3/2013 | Santa Cruz | A63B 21/072 482/108 |
| 2013/0316886 | A1 * | 11/2013 | Lynch | A63B 21/4035 482/146 |
| 2014/0024507 | A1 * | 1/2014 | Hagos | A63B 21/075 482/108 |
| 2014/0194258 | A1 * | 7/2014 | Shorter | A63B 21/072 482/93 |
| 2014/0200120 | A1 * | 7/2014 | Gallagher | A63B 21/015 482/115 |
| 2015/0018132 | A1 * | 1/2015 | Lovelace | A63B 23/03516 473/458 |
| 2016/0256746 | A1 * | 9/2016 | Kramer | A63B 21/4033 |
| 2017/0043205 | A1 * | 2/2017 | Wilson | A63B 21/0435 |
| 2017/0106249 | A1 * | 4/2017 | Marton | A63B 21/00178 |
| 2022/0331645 | A1 * | 10/2022 | Hubble | A63B 21/0004 |

* cited by examiner

SECTION A-A

SECTION B-B

ROTATION RESISTANT EXERCISE DEVICE

FIELD OF THE DISCLOSURE

The disclosure relates to exercise devices, and specifically to a new hand-held lightweight portable exercise device with variable resistance for concomitantly strengthening the entire body, targeted to the upper body, including the core, torso, shoulders, arms, and the like.

BACKGROUND OF THE INVENTION

There are many existing hand-held exercise devices available, most of which rely on gravity for their resistance. Examples of these might be dumbbells, kettle bells, and the like. Some such devices even have a moving mass inside them to provide extra resistance when momentum is applied. Nonetheless, all such devices rely on gravity and/or inertia, and are thus limited in their application and use. There are a select few hand-held exercise devices that employ rotational resistance.

Of these, most are intended to focus mainly or entirely on the muscles of the hands, wrists, and forearms. U.S. Pat. No. 8,747,286 to Simon shows a device with a resistance means similar to that of the current invention, but which uses handles aligned axially with each other. This grip style is useful for exercising the hands, wrists, and forearms, but does not allow the full body movements of the current invention. U.S. Pat. No. 6,071,214 to Osterman shows a device with an alternate means of rotational resistance, however it too positions the hands in such a way as to limit the usefulness of the device to the hands, wrists, and forearms. Although the ends of this device can be gripped with palms opposing each other, the hands are too far apart to be useful for the full body movements required for targeting the muscles of the chest, back, shoulders, and core. U.S. Pat. No. 5,569,125 to Clementi shows a device that provides rotational resistance with handles arranged so that they are gripped with palms facing each other. However, unlike the current invention, the Clementi device uses elastic resistance that automatically snaps back to a resting state, thereby only providing resistance in one direction of movement. Further, there is no variability to the resistance to allow for different user strength or different strength requirements of different muscle groups of the same user. U.S. Pat. No. 4,805,899 to Roehlk again shows a device with handles arranged to be gripped by the palms facing each other. However, this device too only provides resistance in one direction, with the spring driven mechanism snapping back to center automatically. As with the previous device, there is no variability to the resistance level to accommodate different user strengths, or differing strength requirements of different muscle groups of the same user. U.S. Pat. No. 4,643,417 to Nieman shows an exercise device with the gripping handles arranged in an axially aligned manner, again limiting the usefulness of the device to exclusively exercising the hands, wrists, and forearms. It is the object of the present invention to overcome the limitations of the prior devices and provide readily variable resistance to challenge any user, and any muscle group of the same user, while providing multiple grip options to allow full body motions freeing the user to train the muscles of the hands, wrists, arms, shoulders, back, chest, core, and even the lower body when combined with proper full body movements.

SUMMARY OF THE DISCLOSURE

The current invention provides a new and unique method of challenging the muscles of the upper body in a way that allows the various muscle groups to work together, providing a functional, efficient, and dynamic training experience. Moreover, the device and the movements it permits allows exercises to be performed in the transverse plane of the human body, which is frequently ignored, although it is vital for many sports related activities. While there are other exercise products that feature resisted twisting mechanisms such as used in this (PowerSphere™) exercise device, none are designed to give a full upper body workout. The positioning of the two different grip styles of this exercise device allow the user to move in ways that are unique to the device, and recruit different but overlapping sets of large muscle groups in the entire body. Traditional exercises like crunches are greatly enhanced with the present exercise device, while a whole new range of exercises never before possible become available. This exercise device provides resistance in both directions of movement, which serves to work both the "push" and "pull" muscles of the body simultaneously, increasing workout effectiveness, and building balance and coordination between muscle groups. The current invention incorporates unique features, such as rapid adjustment of the tension level, and visual indication of said tension level.

The exercise device provides a resisted twisting motion. When used with full body movements, such as those practiced with a Tai Chi ball, the exercise device provides the user with a unique full body workout. The movements are facilitated by gripping the device either by the handles on each end, or by gripping the spherical surface between the palms, or with a mixed handle and palm grip. All usages feature a palms facing each other grip, which allows for the wide array of body movements that can be achieved with the device. This range of different movements assures that all of the various muscle groups of the upper body and core can be engaged and challenged. When combined with lunging and squatting motions, the entire musculature can be trained. The resisted twisting motion is achieved through a spring which compresses two parts together around a material that acts as a brake pad. A center bolt through the arrangement serves to hold the parts together, and an elongated nut on the bolt provides the variable compressive force on the spring, and thus the brake material.

The invention thus comprises an exercise device arranged to enable muscular engagement of core, pectoral, back, shoulders, hips and lower body muscles, and arms and hands, the device comprising: a first and a second hemispherical housing arrangement resistively rotationally joined about an elongated bolt having a first end secured to the first hemispherical housing and a second end secured to the second hemispherical housing; a rotationally resistive mechanism arranged about the elongated bolt having a second end rotatively arranged within an inner portion of the second hemispherical housing and a first end of the elongated bolt secured to an inner portion of the first hemispherical housing; a tension adjustment mechanism arranged between the first and second hemispherical housings to enable adjustable changing of rotational resistance between the first and the second hemispherical housings. The first and the second hemispherical housing each have a gripping handle extending therefrom to enable rotation of the first and the second hemispherical housing to be tensionally-adjusted and grippingly rotated with respect to one another by a user thereof. The first and the second hemispherical housing each have a palm-engageable gripping material covering an outer portion of each respective hemispherical housing to enable a further open palm gripping on each respective first or second hemispherical housing. The first end of the elongated bolt is secured to a first annular hub in the first hemispherical housing. The rotationally resistive mechanism arranged about the elongated bolt comprises a compressive spring arranged longitudinally there around, wherein the compressive spring biases against a second annular hub, the second annular hub secured to the second hemispherical housing. A rotation resistant brake material is compressively arranged between the first annular hub and the second annular hub to facilitate rotational resistance between the first annular hub and the second annular hub and their respective first and second hemispherical housings.

The invention also comprises a portable full body exercise device comprising: a hollow first housing rotatively engaging a hollow second housing, wherein the first housing and the second housing are rotatively and biasedly engaged with one another, and wherein the first housing and the second housing are rotatively adjusted with respect to one another to increase and decrease angular rotational resistance with respect to one another. The first housing and the second housing are connected to one another by an elongated bolt. An elongated compressive spring is disposed longitudinally about the elongated bolt, wherein the elongated spring has a first end thereof compressed against the second hub in the second housing and the elongated spring has a second end compressed against a washer and a nut arrangement around the bolt in the second housing. The first hub is arranged in the first housing for secure receipt of the opposite end of the bolt therein, and wherein a friction material is arranged between the first hub and the second hub to effect rotative motion therebetween, depending upon the amount of compression generated by the elongated spring thereagainst. Rotation of the second housing with respect to the first housing affects the compression of the elongated spring and the effort necessary to rotate the housings with respect to one another. The changes in the compression spring are indicated by a spring connected gauge visible on the outside of the second housing. The first housing and the second housing are each of hemispherical shape.

The invention also comprises a method of using a portable, personal exercise device, comprising the steps of: arranging a transverse handle on each end of a pair of resistively engaged housings; connecting each housing via a compressively resistant spring arranged longitudinally about an elongated bolt, which bolt connects the housings together; grabbing each transverse handle at the respective ends of the exercise device; rotating one handle and housing in one direction and simultaneously rotating the other handle and housing in the opposite direction. And rotating one housing with respect to the other housing so as to compress the elongated spring disposed about the elongated bolt between a first hub and a second hub so as to initiate a change in rotative resistance by compressing or decompressing a resistant braking material annularly arranged between the first hub and the second hub, to effect effort requirements for further "exercise-use" rotation of the respective housings therewith.

The invention also comprises an exercise device arranged to enable muscular engagement of core, pectoral, back, shoulders, hips and lower body muscles, and arms and hands, the device comprising: a first and a second hemispherical housing arrangement resistively rotationally joined about an elongated bolt having a first end secured within the first hemispherical housing and a second end secured to the second hemispherical housing; a rotationally resistive mechanism arranged about the elongated bolt having a second end rotatively arranged within an inner portion of the second hemispherical housing and a first end of the elongated bolt secured to an inner portion of the first hemispherical housing; a compression adjustment mechanism arranged between the first and second hemispherical housings to enable adjustable changing of rotational resistance between the first and the second hemispherical housings; and a first and a second user-gripping-means on both the first and the second hemispherical housings to enable a device user to use a different gripping manner on each respective hemispherical housing of the device. The first user-gripping-means comprises a handle attached to the first and the second hemispherical housings. The second user gripping means comprises a palm engageable surface on each hemispherical housing. The rotationally resistive mechanism arranged about the elongated bolt comprises an adjustable second hub secured to the second hemispherical housing and a first stationary hub secured to the first hemispherical housing, with a compressible braking material arranged between the first hub and the second hub to effect rotational resistance therebetween. The compression adjustment mechanism includes a radially extending indicator to externally display the existing rotational resistance of the compression adjustment mechanism.

The invention also comprises a spherically shaped exercise device comprised of an interconnected first hemisphere and a second hemisphere, arranged to enable concomitant muscular engagement of core, chest, back, shoulders, hips and lower body muscles, and arms and hands, by user palm-facing-palm engagement of respective ends of the device, the device comprising: a first and a second hemispherically-shaped palm-to-palm-facing-enabled grippable housing arrangement resistively-rotationally joined about an elongated bolt having a first end secured to the first hemispherical housing and a second end secured within the second hemispherical housing, the elongated bolt within the second hemispherical housing having a tabbed washer therearound engaging an tension indicator bracket, the tension indicator bracket having a protrusion distally thereon protruding through the second hemispherical housing to indicate the relative rotative positioning between the housings, and hence set-identifiable tension of the exercise device; a rotationally resistive mechanism arranged about the elongated bolt having a second end rotatively arranged within an inner portion of the second hemispherical housing and a first end of the elongated bolt secured to an inner portion of the first hemispherical housing, wherein the rotationally resistive mechanism arranged about the elongated bolt comprises a compressive spring arranged longitudinally there around, wherein the compressive spring is biasable against a second annular hub, the second annular hub being non-rotatively secured within the second hemispherical housing; a first annular hub secured within the first hemispherical housing, with the elongated bolt secured within the first annular hub, and, an annularly-shaped friction inducing compressible brake member rotationally unconstrained, pre-compressed, in an annulus between the second annular hub and the first annular hub; a rotationally effected tension adjustment mechanism arranged between the first and second hemispherical housings to enable adjustable changing of rotational resistance between the first and the second hemispherical housings; and wherein the rotationally resistive mechanism arranged about the elongated bolt comprises the adjustable second hub secured to the second hemispherical housing and the first stationary hub secured to the first hemispherical housing, with the compressible brake member arranged in the annulus between the first hub and the second hub to effect rotational resistance therebetween when biased between the first and second hubs.

The invention also comprises a spherically shaped opposed, palm-grippable exercise sphere, the exercise sphere comprising: a first hemispherically shaped housing and a second hemispherically shaped housing rotatably connected together by an elongated bolt, the elongated bolt having a first end secured within a first inner hub secured within the first housing, the elongated bolt having a second end secured within an elongated nut which is secured within an anti-rotational sleeve within the second housing; a second inner hub secured to the second housing, with a compressive spring arranged around the elongated bolt, the compressive spring disposedly spaced between the second inner hub and the elongated nut so as to enabaly bias the second inner hub towards the first inner hub; and a disk-shaped annular brake member arranged in an annulus between the first inner hub and the second inner hub so as to create an adjustable controlled rotational resistance between the first housing in the second housing when a user generates rotation between the first housing and the second housing. The elongated anti-rotational sleeve has a tension indicating bracket attached to a side thereof. The tension indicating bracket has a protrusion on a distal end thereof which extends through the second housing indicate to the user the pre-existing tension within the exercise sphere. The annular brake member is free-floating within the annulus between the first inner hub in the second inner hub until it is compressed therebetween by the compressive spring. The elongated nut secured within the anti-rotation sleeve permits a change in rotational resistance by a compression change in the compression spring against the second hub when the second housing is rotated with respect to the first housing.

BRIEF DESCRIPTION OF THE DRAWINGS

The objects and advantages of the present invention will be better understood through examination of the drawings, in which.

DESCRIPTION OF THE PREFERRED EMBODIMENTS

Figure 1:
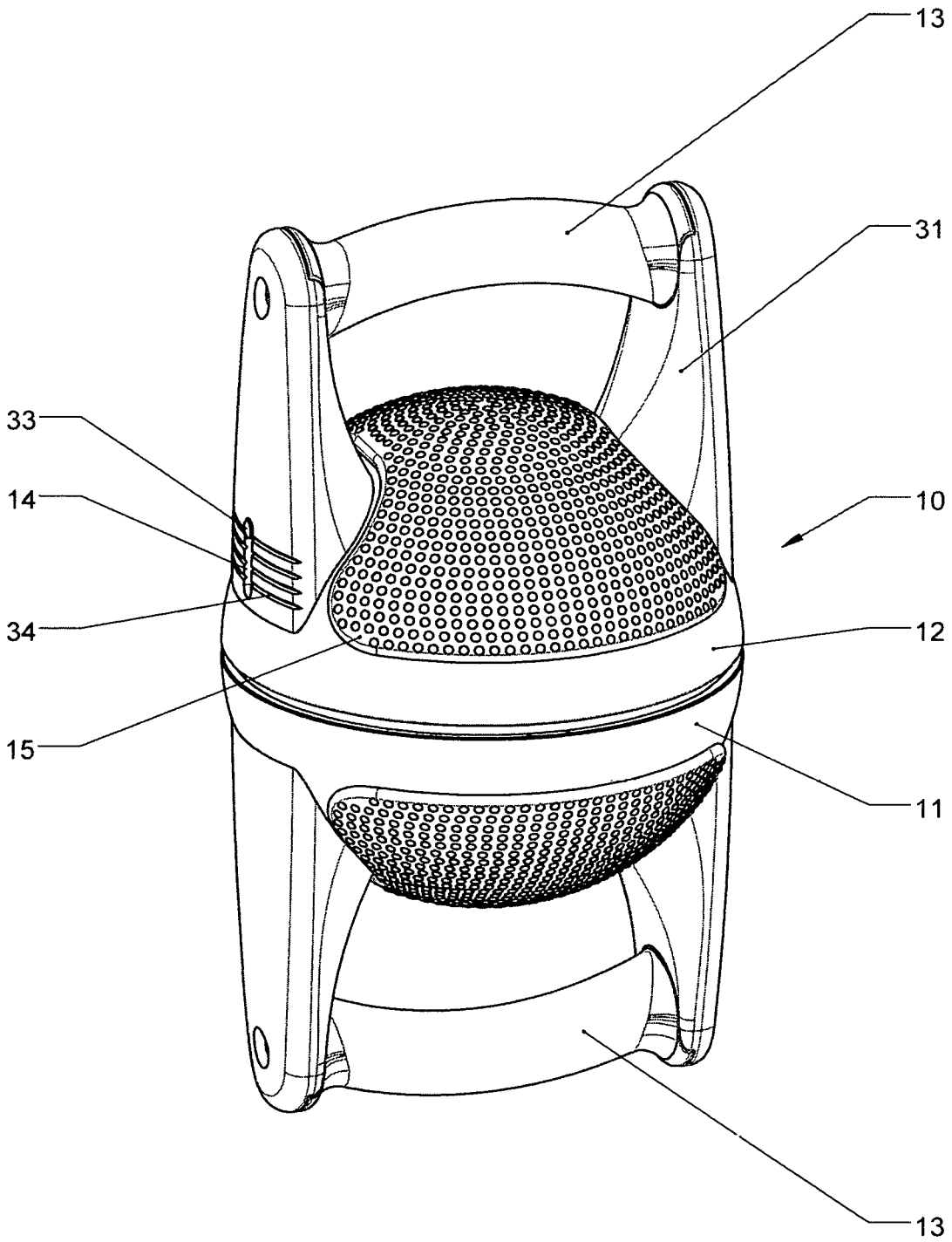
FIG. 1 is a perspective view of the fully assembled exercise device.
Figure 2:
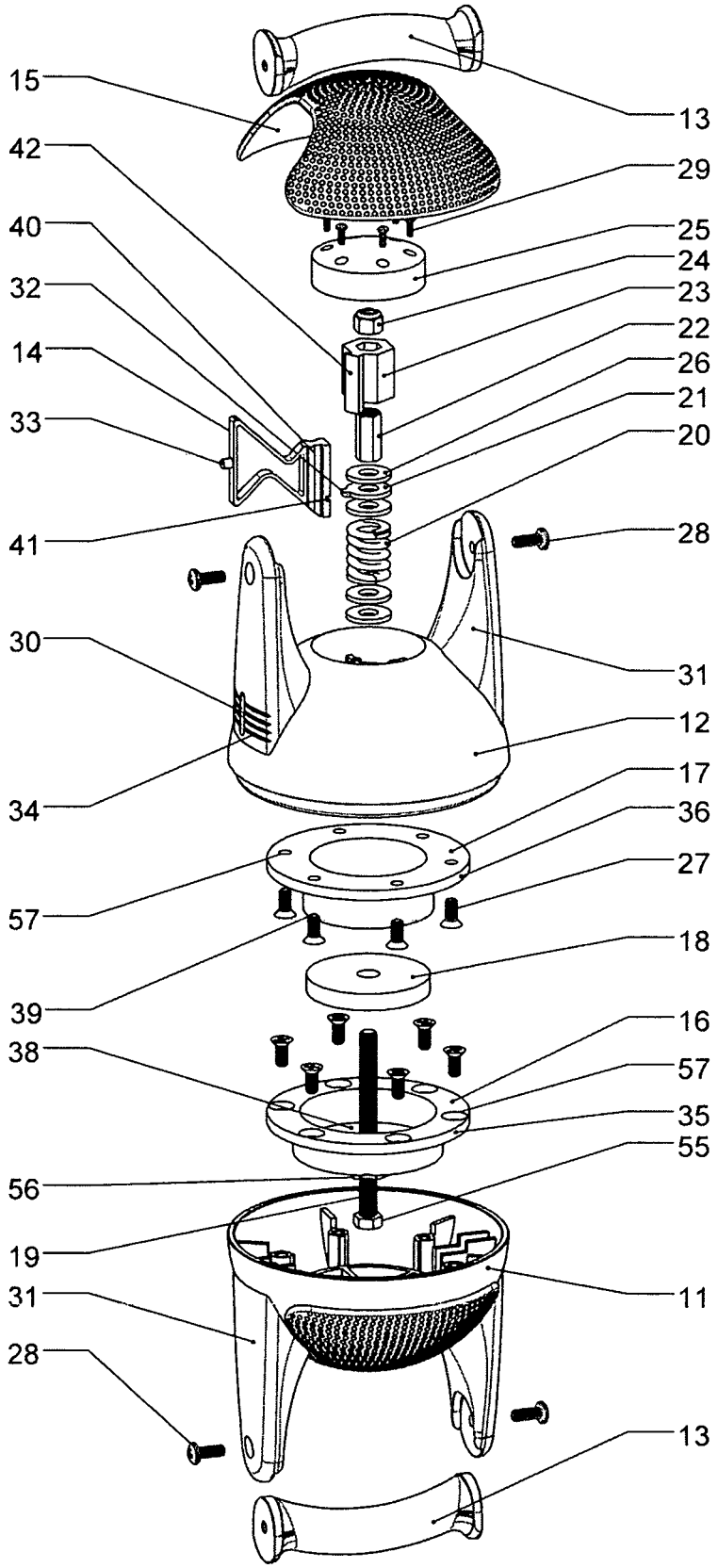
FIG. 2 is an exploded view of the exercise device, allowing viewing of all components thereof.
Figure 3:
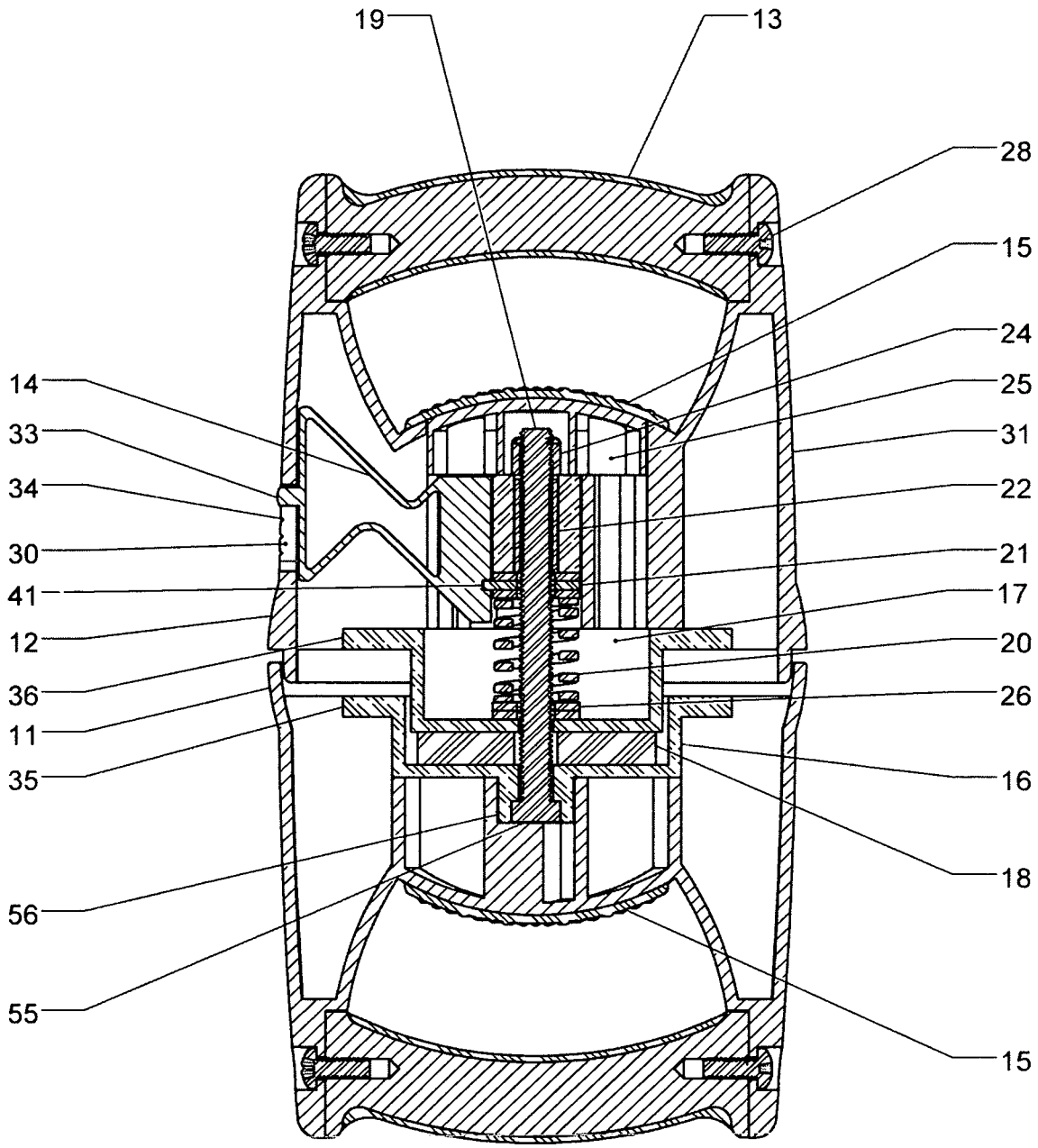
FIG. 3 is a section view A-A through the front plane of the exercise device, as represented in FIG. 7, depicting where the internal components are relative to each other.

The present invention, (commercially named the PowerSphere™) comprises an exercise device or assembly 10, which consists of an independently rotatable first and a second hollow hemispherically-shaped housing 11 and 12, respectively, as shown in the drawing FIGS. 1 and 2. Each housing 11 and 12 has a pair of supporting stalks 31 protruding outward for the purpose of affixing a handle 13 to each housing 11 and 12, for gripping the exercise assembly 10, as best shown in FIG. 1. The handles 13 are attached to and between their respective supporting stalks 31 via bolts 28, as shown in FIG. 3. The exercise assembly 10 can be held either by the handles 13, and/or by a non-slip hemispherical surface 15 affixed to each hemispherical housing 11 and 12, with one hand of the user on either handle 13 or gripping surface 15. Each hemispherical surface 15 is preferably a tactile grip material as shown in FIG. 1. In the preferred embodiment, these hemispherical housings 11 and 12 are preferably molded from a sturdy yet lightweight material such as plastic or aluminum. Inside the two hemispherical housings 11 and 12 is a multi-hand-positional, hand adjustable, position-visible indicator variable resistance tensioning assembly shown in FIGS. 5 and 6, and as shown FIGS. 3 and 4.

Figure 4:
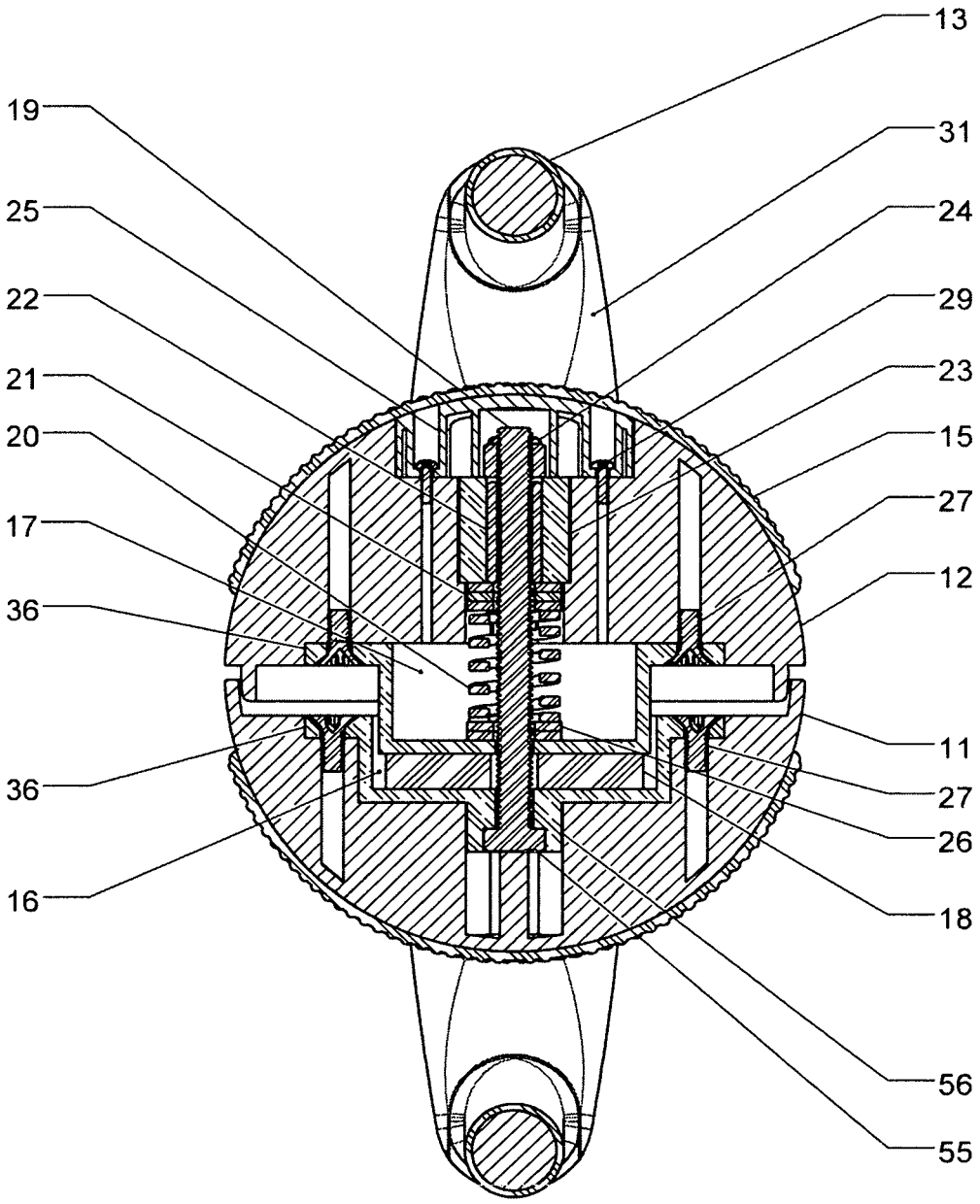
FIG. 4 is a section view B-B through the right plane of the exercise device, as represented in FIG. 8, allowing viewing of internal components not visible in FIG. 3.
Figure 5:
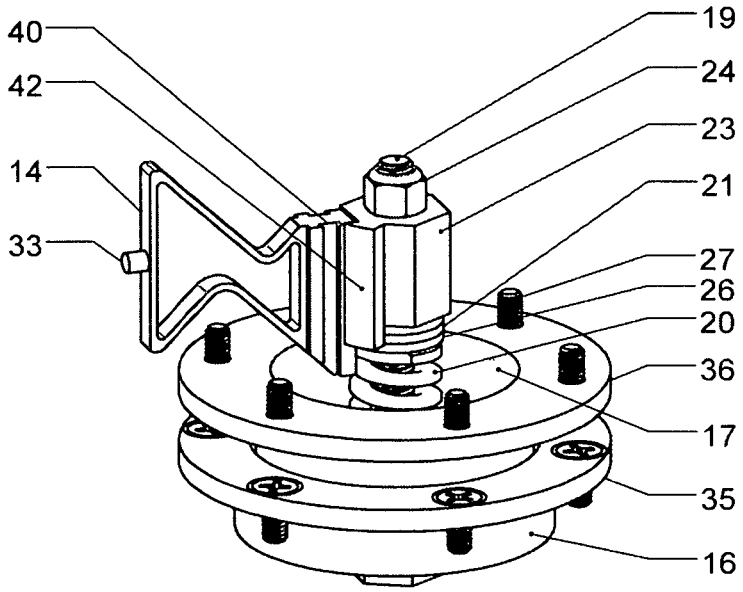
FIG. 5 is a view of the core components of the exercise device, in a state where no tension is in the resistance mechanism.
Figure 6:
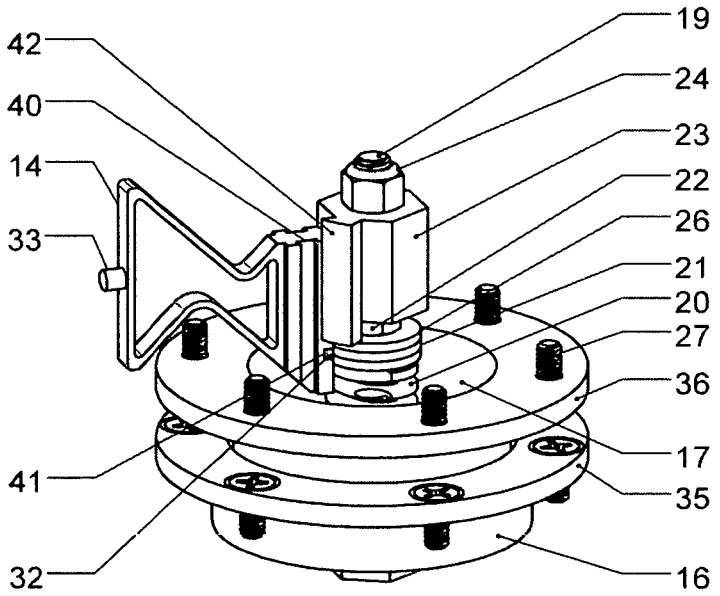
FIG. 6 is a view of the core components of the exercise device, in a partially tensioned state.
Figure 7:
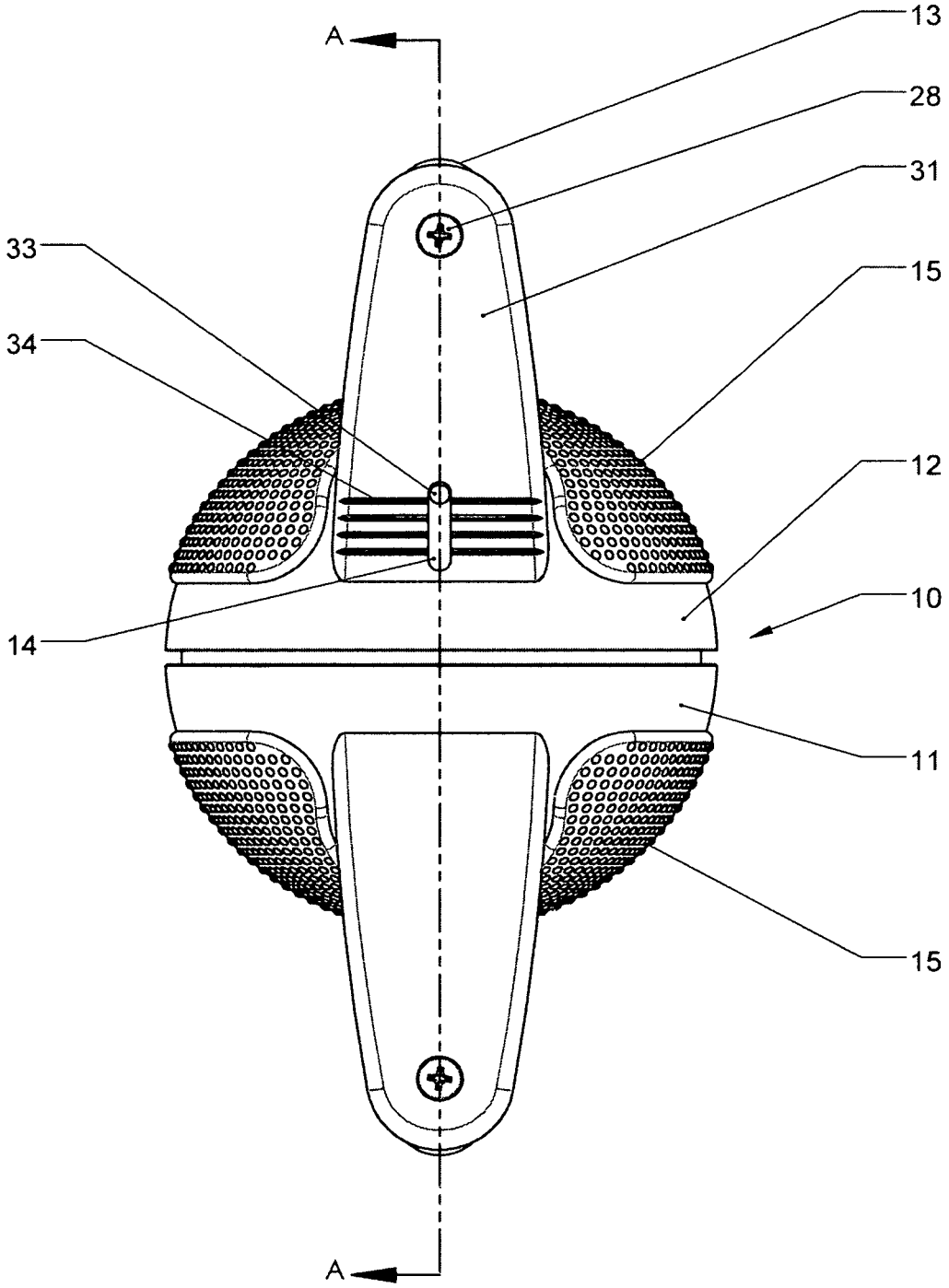
FIG. 7 is a side view showing the section line used for FIG. 3.
Figure 8:
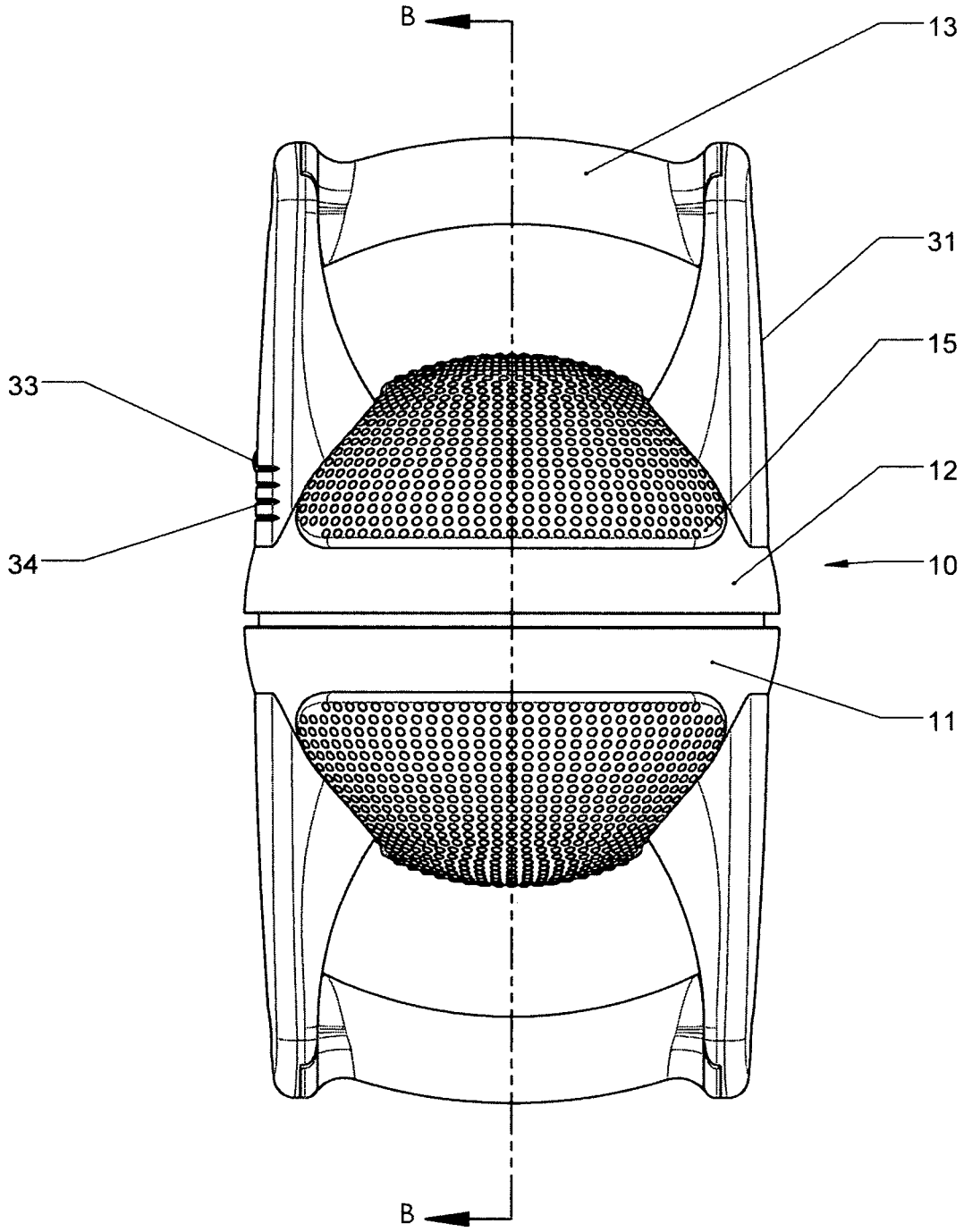
FIG. 8 is a front view showing the section line used for FIG. 4.

This resistance and tensioning mechanism shown prominently in FIGS. 5 and 6 is permanently affixed to the outer hemispherical housings 11 and 12 as represented in FIGS. 3 and 4. In order to survive the friction, heat, and other rigors of usage, metal or another more robust material may be used to form a first and a second inner hub 16 and 17 respectively, as shown in FIGS. 2, 3 and 4. These first and second inner hubs 16 and 17 each have an annular flange 35 and 36 respectively, shown in FIGS. 2-6, with holes 57 to provide means of bolted attachment to their respective first and second outer hemispherical housings 11 and 12, and are attached by bolts 27 to the outer hemispherical housings 11 and 12, as best shown in FIG. 4.

In between these metal inner hubs 16 and 17, which each have a flat, smooth annular friction-enduring braking-surface 38 and 39 facing each other, as represented in FIG. 2, is a rotationally unconstrained (pre-compressed) frictional disc-shaped rotational resistance brake member 18 arranged to affect energy-required twisting to permit respective rotation of the hub 16 attached to and within the first housing 11 and the hub 17 within and attached to the second housing 12, when pressured therebetween.

An elongated connecting bolt 19, which holds the two hemispherical housings 11 (first) and 12 (second) together, best shown in FIG. 3, is non-rotatively captured in the lower inner hub 16, in a manner rotationally locking the elongated bolt 19 to the inner lower hub 16. Circular brake member 18 is compressed in an annulus between the second hub 17 and the first hub 16 by pressure of the adjustably compressed elongated spring 20, to effect the resistance to rotation between the hubs 16 and 17, and thus resistance to rotation between the first housing 11 and the second housing 12 for the exercise effect of a user to rotate them relative to one another. The elongated bolt 19 also collectively extends through a central opening in the upper hub 17, a set of washers 26 and through the compressive spring 20, as may be seen in FIGS. 2, 3 and 4.

A tabbed washer 21, and an elongated nut 22, are permanently captured by an upper or distal lock nut 24, as shown in section in FIGS. 2 and 3. The elongated nut 22 fits within an anti-rotation sleeve 23, as shown in FIG. 2. The anti-rotation sleeve 23 is captured within an outer sleeve 51, shown best in FIG. 9, which is integral to the second housing 12. A curved cap 25 is attached to the second housing 12, as shown in FIGS. 3 and 4, to complete the hemispherical shape of the second housing 12 and the spherical shape of the whole assembly/device 10. The elongated bolt 19 has a hex head 55, which is rotationally captured by a hexagonally shaped recess 56 in the lower inner hub 16, as shown in FIGS. 3 and 4. The upper or second hub 17 and the second hemispherical housing 12 are arranged over the elongated bolt 19 and a series of upper washers 26 and a tabbed washer 21 are arranged around the elongated bolt 19. The elongated nut 22, captured in the hex shaped anti-rotational sleeve 23 enables the (upper) housing half 12 of the assembly 10 to automatically activate the resistance mechanism (defined more completely hereinbelow), when the upper (second) half 12, as shown in the drawings, is rotated relative to the lower (first) half 11, thus permitting a user's palm-to-palm gripping on opposed hemispherical surfaces 15 and 15.

The elongated connecting bolt 19 with its rotationally lockable hex head 55 engaged in the lower inner hub 16, is captured by the first hemispherical housing 11 placed over the elongated bolt 19, and the series of upper washers 26 and the compressive spring 20 which are arranged around the upper portion of the elongated bolt 19, as shown in FIG. 2. One of the upper washers 21 has a tab 32, as shown in FIG. 2, extending radially outward and is captured by a horizontally oriented slot 41, shown in FIGS. 2, 3 and 6, in order to interact with and activate the externally visible tension-indicating bracket 14, (as shown in FIGS. 2, 3, 5, 6 and 7), observably moving the visible resistance-indicating-protrusion 33 thereon, (longitudinally in slot 30) to indicate the amount of resistance the exercise device 10 is set at currently, depending upon the relative rotational tightness between the housings 11 and 12. This viewing slot 30 may have markings 34 to indicate a monitorable relative resistance level to which the exercise device 10 is currently set, or may be set. The resistance mechanism level is adjusted by rotation of the housings 11 and/or 12, relative to the other housing 12 or 11, thus compressing or decompressing the (resistance mechanism) elongated-bolt-surrounding elongated spring 20 and brakingly rubbing or separating the associated rotation-resistant braking components, that is, the hubs 16 and 17 and squeezing (or un-squeezing) the otherwise rotationally-unconstrained brake pad member 18 therebetween.

Figure 9:
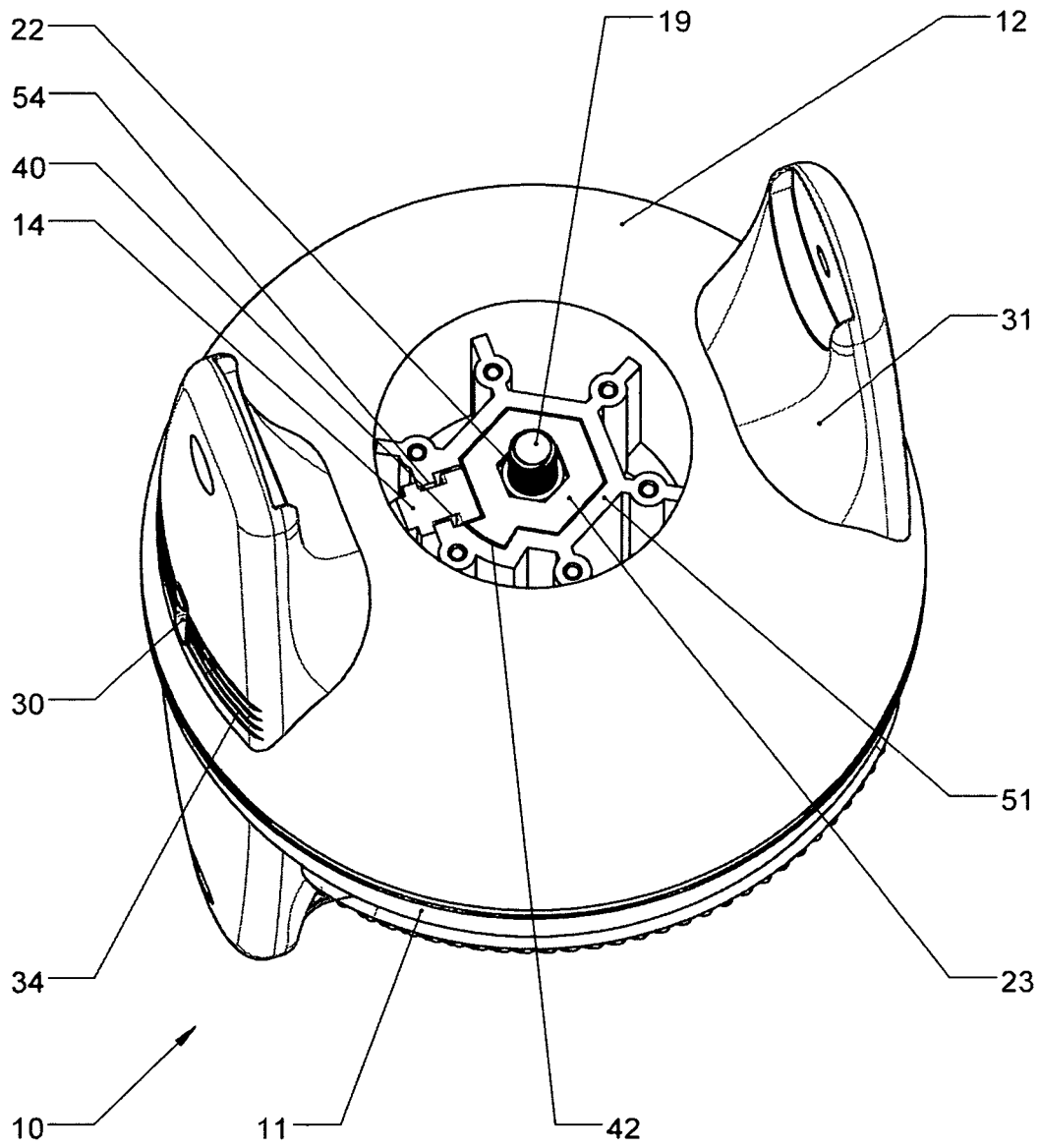
FIG. 9 is an overhead view with the top handle, grip material, cap, and locknut removed to allow many of the functioning components to be seen.

The elongated nut 22 is threaded onto the elongated bolt 19 at the outer end of the series of washers 26, as may be seen in FIGS. 2, 3 and 4. This elongated nut 22 resides in a cavity 51 in the second hemispherical housing 12 that is large enough to allow the elongated nut 22 to spin freely, as represented in FIG. 9. The upper part of this cavity 51 as shown in FIG. 9, is hexagonally (or otherwise anti-rotationally) shaped. Another hexagonal (or other matching anti-rotational shape) sleeve 23 is arranged into this elongated chamber 51, to enable the capture of the elongated nut 22, subsequent to the engagement of the nut 22 within the cavity 51, preventing it from turning relative to the second hemispherical housing 12, as may be envisioned from FIG. 9.

The anti-rotational hexagonal sleeve 23 shown in FIGS. 2, 3, 4 and 9, is subsequently captured by the hexagonally shaped cavity 51 in the second hemispherical housing 12, and is thus prevented from turning independently of the second hemispherical housing 12. This forces the elongated nut 22 to turn when the two hemispherical housings 11 and 12 of the exercise device 10 are rotated relative to one another, thus increasing or decreasing the tension in the exercise device 10 as the elongated nut 22 moves up and down the elongated bolt 19, compressing or decompressing the spring 20, thus increasing or decreasing the length of the elongated spring and hence the pressure applied to the friction brake member 18 residing between the two inner hubs 16 and 17. This increases or decreases the amount of force the user must apply in order to turn the two housings 11 and 12 of the exercise device 10 relative to one another. Half a rotation (180 degrees, as used while exercising) creates a minimally noticeable differential in the tension, but when turned several times (i.e. 360 or 720 degrees) before actually exercising or between exercises, (enough to visibly move the tension indicator bracket 14) as shown by FIG. 6 relative to FIG. 5, the tension will increase or decrease dramatically, as shown by the partially compressed spring 20 also shown in FIG. 6. This variability in the tension ensures that the exercise device 10 can be used by any exerciser able to hold the device as it is intended to be used. The hexagonal sleeve 23 and all other tensioning mechanism parts are permanently trapped in place by a locknut 24, shown in FIGS. 2, 3, 4 and 5 threaded onto the end of the elongated bolt 19, which is subsequently covered by the domed-shaped cap 25, held in place by screws 29 or other means, completing the spherical shape of the upper or second hemispherical housing 12 of the exercise device 10.

The elongated nut 22 secured within the non-rotatable elongated sleeve 23 which itself is anti-rotatively captured within the outer sleeve 51, as shown best in FIG. 9, all captured within the second housing 12, permits the user's palm-facing-palm engagement on the respective gripping surfaces, 15 and 15, on the first and second housings 11 and 12, for full body exercise not available with the prior art devices.

In order to facilitate gripping the spherical surface of the exercise assembly 10, the non-slip gripping material 15 is applied to both the first and second hemispherical housings 11 and 12 as part of the final assembly to permit the user several ways to grip the device 10, either by the handles 13, and/or by his/her palms engaging the gripping material 15 on the housings 11 and 12.

The invention claimed is:

1. A portable full body exercise device comprising:

a palm-grippable hollow first housing rotatively engaging a palm-grippable hollow, gauge bearing second housing, wherein the first housing and the second housing are rotatively and biasedly engaged with one another, and wherein the first housing and the second housing are monitorably and rotatively adjustable with respect to one another to permit a user-enabled gauge-indicated increase or decrease display of angular rotational resistance with respect to one another.

2. The exercise device as recited in claim 1, wherein the first housing and the second housing are connected to one another by an elongated bolt.

3. The exercise device as recited in claim 2, wherein an elongated compressive spring is disposed about the elongated bolt, and wherein the elongated spring has a first end thereof compressed against a second hub in the second housing and the elongated spring has a second end compressed against a washer and a nut arrangement around the bolt in the second housing.

4. The exercise device as recited in claim 3, wherein a first hub is arranged in the first housing for secure receipt of the first end of the bolt therein, and wherein a friction generating brake material is arranged between the first hub and the second hub to affect rotative resistance therebetween, depending upon the amount of compression generated by the elongated spring thereagainst.

5. The exercise device as recited in claim 4, wherein the second housing is rotatable with respect to the first housing to permit the adjustment of the compressed length of the elongated spring surrounding the elongated bolt, and thus change the effort necessary to rotate the housings with respect to one another.

6. The exercise device as recited in claim 5, wherein changes in the compression spring are indicated by a spring connected gauge on the outside of the second housing.

7. The exercise device as recited in claim 1, wherein the first housing and the second housing are each of hemispherical shape.

8. An exercise device arranged to enable concomitant muscular engagement of core, chest, back, shoulders, hips and lower body muscles, and arms and hands, the device comprising:

a first and a second hemispherical housing arrangement resistively rotationally joined about an elongated bolt having a first end secured within the first hemispherical housing and a second end secured to the second hemispherical housing;

a rotationally resistive mechanism arranged about the elongated bolt having a second end rotatively arranged within an inner portion of the second hemispherical housing and a first end of the elongated bolt secured to an inner portion of the first hemispherical housing;

a compression adjustment mechanism arranged between the first and second hemispherical housings to enable adjustable changing of rotational resistance between the first and the second hemispherical housings; and a first and a second user-gripping-means on both the first and the second hemispherical housings to enable the device user to use a different gripping manner on each respective hemispherical housing of the device.

9. The exercise device as recited in claim 8, wherein the first user-gripping-means comprises a handle attached to the first and the second hemispherical housings.

10. The exercise device as recited in claim 9, wherein the second user gripping means comprises a palm engageable surface on each hemispherical housing.

11. The exercise device as recited in claim 8, wherein the rotationally resistive mechanism arranged about the elongated bolt comprises an adjustable second hub secured to the second hemispherical housing and a first stationary hub secured to the first hemispherical housing, with a compressible braking material arranged between the first hub and the second hub to effect rotational resistance therebetween.

12. The exercise device as recited in claim 8, wherein the compression adjustment mechanism includes a radially extending indicator bracket to externally display the existing rotational resistance of the compression adjustment mechanism.

13. A spherically shaped, opposed palm-grippable exercise sphere, the exercise sphere comprising:

a first hemispherically shaped housing and a second hemispherically shaped housing rotatably connected together by an elongated bolt, the elongated bolt having a first end secured within a first inner hub secured within the first housing, the elongated bolt having a second end secured within an elongated nut which elongated nut is secured within an anti-rotational sleeve within the second housing;

a second inner hub secured to the second housing, with a compressive spring arranged around the elongated bolt, the compressive spring disposedly spaced between the second inner hub and the elongated nut so as to enable the bias of the second inner hub towards or away from the first inner hub; and a disk-shaped annular brake member arranged in an annulus between the first inner hub and the second inner hub so as to create an adjustable controlled rotational resistance between the first housing and the second housing when a user generates rotation between the first housing and the second housing.

14. The spherically shaped, opposed palm-grippable exercise sphere as recited in claim 13, wherein the anti-rotational sleeve has a position indicating bracket attached to a side thereof.

15. The spherically shaped, opposed palm-grippable exercise sphere as recited in claim 14, wherein the position indicating bracket has a protrusion on a distal end thereof which extends through the second housing to indicate to the user the pre-existing tension within the exercise sphere.

16. The spherically shaped, opposed palm-grippable exercise sphere as recited in claim 13, wherein the annular brake member is free-floating within the annulus between the first inner hub in the second inner hub until it is compressed therebetween by the compressive spring.

17. The spherically shaped, opposed palm-grippable exercise sphere as recited in claim 13, wherein the elongated nut secured within the anti-rotation sleeve permits a change in rotational resistance by a compression change in the compression spring against the second hub when the second housing is rotated with respect to the first housing.

18. A spherically shaped exercise device having a first half and a second half, arranged to enable concomitant muscular engagement of core, chest, back, shoulders, hips and lower body muscles, and arms and hands, by palm-facing-palm engagement of respective ends of the device, the device comprising:

a first and a second hemispherical-shaped palm-to-palm-facing-enabled grippable housing arrangement resistively rotationally joined about an elongated bolt having a first end secured to the first hemispherical housing and a second end secured to the second hemispherical housing;

a rotationally resistive mechanism arranged about the elongated bolt having a second end rotatively arranged within an inner portion of the second hemispherical housing and a first end of the elongated bolt secured to an inner portion of the first hemispherical housing;

a compressive adjustment mechanism arranged between the first and second hemispherical housings to enable adjustable changing of rotational resistance between the first and the second hemispherical housings.

19. The exercise device as recited in claim 18, wherein the first and the second hemispherical housing each have a gripping handle extending therefrom to enable rotation of the first and the second hemispherical housing to be positionally adjusted and grippingly rotated with respect to one another by a user thereof.

20. The exercise device as recited in claim 18 wherein the first and the second hemispherical housing each have a hemispherically-shaped palm-engageable gripping material covering an outer portion of each respective hemispherical housing to enable a further open palm gripping on each respective first or second hemispherical housing.

21. The exercise device as recited in claim 18, wherein the first end of the elongated bolt is secured to a first annular hub in the first hemispherical housing.

22. The exercise device as recited in claim 21, wherein the rotationally resistive mechanism arranged about the elongated bolt comprises a compressive spring arranged longitudinally there around, wherein the compressive spring biases against a second annular hub, the second annular hub being secured to the second hemispherical housing.

23. The exercise device as recited in claim 22, wherein a rotation resistant brake material is compressively arranged between the first annular hub and the second annular hub to facilitate rotational resistance between the first annular hub and the second annular hub and their respective first and second hemispherical housings.

24. A spherically shaped exercise device comprised of an interconnected first hemisphere and a second hemisphere, arranged to enable concomitant muscular engagement of core, chest, back, shoulders, hips and lower body muscles, and arms and hands, by palm-facing-palm engagement of respective ends of the device, the device comprising:

a first and a second hemispherical-shaped palm-to-palm-facing-enabled grippable housing arrangement resistively-rotationally joined about an elongated bolt having a first end secured to the first hemispherical housing and a second end secured within the second hemispherical housing, the elongated bolt within the second hemispherical housing having a tabbed washer therearound engaging a rotational resistance indicator bracket, the rotational resistance indicator bracket having a protrusion distally thereon protruding through the second hemispherical housing to indicate relative rotative positioning between the housings, and hence set-identifiable rotational resistance of the exercise device;

a rotationally resistive compressive mechanism arranged about the elongated bolt having a second end rotatively arranged within an inner portion of the second hemispherical housing and a first end of the elongated bolt secured to an inner portion of the first hemispherical housing, wherein the rotationally resistive compressive mechanism arranged about the elongated bolt comprises a compressible spring arranged longitudinally there around, wherein the compressible spring is biasable against a second annular hub, the second annular hub being non-rotatively secured within the second hemispherical housing;

a first annular hub secured within the first hemispherical housing, with the elongated bolt secured within the first annular hub, and, an annularly-shaped friction inducing compressible brake member rotationally unconstrained, pre-compressed, in an annulus between the second annular hub and the first annular hub;

wherein the rotationally resistive compressive mechanism is arranged between the first and second hemispherical housings to enable adjustable changing of rotational resistance between the first and the second hemispherical housings; and wherein the rotationally resistive compressive mechanism arranged about the elongated bolt compresses against both the second annular hub secured to the second hemispherical housing and to the first stationary hub secured to the first hemispherical housing, with the compressible brake member arranged in the annulus between the first hub and the second hub to effect rotational resistance therebetween when biased between the first and second hubs.

25. A method of using a portable, personal exercise device, comprising the steps of:

arranging a transverse handle on each end of a pair of resistively engaged housings;

connecting each housing via a compressively resistant spring arranged longitudinally about an elongated bolt, which bolt connects the housings together;

gripping each transverse handle at the respective ends of the exercise device;

rotating one handle and housing in one direction and simultaneously rotating the other handle and housing in the opposite direction; and wherein the method includes rotating one housing with respect to the other housing so as to compress or decompress the elongated spring disposed about the elongated bolt between a first hub and a second hub so as to initiate a change in rotative resistance by compressing or decompressing a resistant braking material annularly arranged between the first hub and the second hub, to effect effort requirements for further rotation of the respective housings therewith.

* * * * *